US006834814B1

(12) United States Patent
Beckman

(10) Patent No.: US 6,834,814 B1
(45) Date of Patent: Dec. 28, 2004

(54) ADJUSTABLE PATTERN IRRIGATION SYSTEM

(76) Inventor: Alfred James Beckman, 10806 V St., Omaha, NE (US) 68137

( * ) Notice: Subject to any disclaimer, the term of this patent is extended or adjusted under 35 U.S.C. 154(b) by 3 days.

(21) Appl. No.: 10/462,260

(22) Filed: Jun. 16, 2003

(51) Int. Cl.[7] ..... B05B 3/00

(52) U.S. Cl. ..... 239/227; 239/97; 239/225.1; 239/236; 239/DIG. 1

(58) Field of Search ..... 239/97, 225.1, 239/227, 230–233, 236, DIG. 1

(56) References Cited

U.S. PATENT DOCUMENTS

| | | | | |
|---|---|---|---|---|
| ,691,859 A | | 1/1902 | Hart | |
| 1,239,952 A | * | 9/1917 | Perry | 239/236 |
| 1,710,107 A | | 4/1929 | Orr | |
| 1,796,942 A | | 3/1931 | Pottenger, Jr. | |
| 1,938,838 A | | 12/1933 | Jacobson | 299/18 |
| 1,962,308 A | | 6/1934 | Jacobson | 299/18 |
| 2,545,745 A | * | 3/1951 | Roy | 239/227 |
| 2,601,559 A | | 6/1952 | Riblet | 299/18 |
| 2,654,635 A | | 10/1953 | Lazzarini | 299/18 |
| 2,780,488 A | | 2/1957 | Kennedy | 299/18 |
| 2,979,271 A | | 4/1961 | Boyden | 239/236 |
| 2,999,645 A | | 9/1961 | Kennedy | 239/230 |
| 3,026,044 A | | 3/1962 | Kennedy | 239/97 |
| 3,033,469 A | * | 5/1962 | Alfred | 239/230 |
| 3,081,039 A | | 3/1963 | Kennedy | 239/230 |
| 3,091,399 A | | 5/1963 | Kennedy | 239/231 |
| 3,232,539 A | | 2/1966 | Hait | 239/222.15 |
| 3,244,373 A | | 4/1966 | Hait | 239/233 |
| 3,405,871 A | | 10/1968 | Mullan | 239/236 |
| 3,428,256 A | | 2/1969 | Painter | 239/206 |
| 3,451,623 A | | 6/1969 | Dibrell | 239/97 |
| 3,528,093 A | | 9/1970 | Eerkens | 239/97 |
| 3,780,948 A | * | 12/1973 | Kumaoka | 239/236 |
| 3,782,637 A | * | 1/1974 | Crumpacker | 239/232 |
| 3,878,990 A | | 4/1975 | Geraudie | 239/236 |
| 3,952,954 A | | 4/1976 | Taylor | 239/236 |
| 3,960,327 A | | 6/1976 | Olson | 239/236 |
| 4,198,001 A | | 4/1980 | Rodriguez | 239/227 |
| 4,296,815 A | * | 10/1981 | Mears | 169/37 |
| 4,474,328 A | | 10/1984 | Hale | 239/227 |
| 4,637,549 A | | 1/1987 | Schwartzman | 239/230 |
| 5,248,093 A | | 9/1993 | Pleasants | 239/239 |
| 5,366,157 A | | 11/1994 | Pleasants | 239/239 |
| 6,079,637 A | | 6/2000 | Ohayon | 239/236 |

* cited by examiner

*Primary Examiner*—J. Casimer Jacyna
(74) *Attorney, Agent, or Firm*—Thomte, Mazour & Niebergall; Shane M. Niebergall

(57) ABSTRACT

An adjustable pattern irrigation device is provided with a head member that is pivotably coupled to a plurality of arm members that further serve as a break for incoming water. A cam and follower determine the trajectory of the tilting head member. A plurality of removable and interchangeable cams having an endless number of shapes provided different planned irrigation patterns. Adjustment plates are optionally coupled to the cams to allow for adjustments to the irrigation patterns.

28 Claims, 6 Drawing Sheets

ADJUSTABLE PATTERN IRRIGATION SYSTEM

BACKGROUND OF THE INVENTION

The present invention relates to irrigation devices and more particularly to a sprinkler that is capable of multiple pattern variations to irrigate irregularly-shaped areas.

DESCRIPTION OF THE PRIOR ART

Residential and commercial irrigation systems are readily available in a variety of configurations for the irrigation of lawns, gardens, landscaping, crops, and the like. Many of these applications provide an area to be irrigated that is irregularly shaped. One of the most common irregular areas that requires irrigation is the ubiquitous rectangular-shaped residential lawn. The corners and straight perimeters of residential lawns provide a challenge to those people who use rotating sprinkler heads, especially those that are positioned on a mobile base and must be strategically repositioned throughout the yard in an attempt to obtain full coverage with the circular spray pattern.

Typical impact or rotary head sprinklers provide a circular spray pattern as the head of the sprinkler travels in its 360° path. The formation of circular spray patterns causes the individual to frequently move the sprinkler to deliver water to each of the outlaying perimeter and corner areas. Typically, the only alternative is to simply position the sprinkler unit adjacent the corner area and deliver a sufficient volume of water through the sprinkler unit to reach the farthest point of the corner. However, this method typically delivers a large volume of water beyond the perimeter of the corner, or worse, only serves to water the fence or adjacent properties.

The need to conserve water and the desire to simplify the process of irrigating irregular plots of land has led to the development of several different improvements to the typical rotary or impact type of sprinkler unit. U.S. Pat. No. 3,528,093 discloses an impact sprinkler head that uses a cam and follower to regulate the volume of water being discharged from the sprinkler head as it rotates along its circular path. By varying the water flow, the system is purportedly capable of forming "generally square patterns." U.S. Pat. No. 3,081,039 discloses an impact sprinkler device that uses a cam and follower system to change the trajectory of the water being discharged from the sprinkler unit. In this system, the sprinkler head is positioned directly on top of the water column that is forced into the unit and up through the sprinkler stem. This arrangement frequently causes a problem in that the force of the water traveling through the system and up the stem directly impacts the pivoting joint that couples the sprinkler head to the stem. The force of the water makes it difficult, if not impossible, to smoothly and accurately pivot the sprinkler head. To that end, the '039 patent teaches the necessity of an adjustable weight member that is coupled to an arm extending from the lower end of the follower in order to force the movement of the sprinkler head into and out of its desired angle of discharge.

Other prior art systems have attempted to combine the two methodologies of variable water flow and discharge trajectory in order to create a more efficient and accurate system. One example of such a device is disclosed within U.S. Pat. No. 5,248,093. However, most systems taking this approach are overly complex, rendering them expensive to manufacture and susceptible to multiple and frequent mechanical error. The adjustments and upkeep of such a system, combined with its cost, render it impractical for most applications.

Accordingly, what is needed is an irrigation device that is simple in construction and operation, yet accurate in its formation of variable discharge patterns.

SUMMARY OF THE INVENTION

The sprinkler device of the present invention is provided with a head member having a fluid inlet and a discharge nozzle. A support member is pivotably coupled to the fluid inlet portion of the head member to permit the selective alteration of the angle at which the discharge nozzle of the head member is oriented. The support member is rotatably coupled with a stem member to permit the head and support members to rotate in a circular manner. The support member is provided with a plurality of arm members that separate and divert the column of water after it enters the support member. The arm members then rejoin the separate water columns at the base of the head member. In this manner, the arm members provide a water brake to limit the "impact" effect of the water column as well as a pivoting joint to allow for the smooth and effortless change in discharge trajectory.

An elongated follower extends outwardly from the head member to engage the peripheral edge of a cam, which is coupled to the stem member. As the sprinkler rotates, the follower is directed along the shape of the cam to systematically raise and lower the pitch of the head member. The shape of the cam member determines the irrigation pattern of the system. Accordingly, it is preferred that the cam be removably coupled to the stem member so that additional cam members of different shapes can be interchanged as needed.

The sprinkler can also be fit with an adjustable cam, having an adjusting plate that is slidably engaged with the upper or lower surface of the cam. The adjusting plate selectively changes the shape of the cam and, thus, the irrigation pattern of the sprinkler device. A plurality of adjustment plates can be provided to simultaneously adjust the shape of the cam in more than a single direction.

Accordingly, it is a principal object of the present invention to provide an improved irrigation device that is capable of variable irrigation patterns.

A further object of the present invention is to provide an improved irrigation device that is capable of variable irrigation patterns but simple in construction and operation.

Yet another object of the present invention is to provide an improved variable pattern irrigation device that is capable of simple irrigation pattern shape adjustments.

Still another object of the present invention is to provide an improved variable pattern irrigation device having a plurality of interchangeable pattern cams for the selective variation of the irrigation pattern.

Yet another object of the present invention is to provide a system for varying irrigation patterns that can be used with many different types of irrigation systems.

These and other objects will be apparent to those skilled in the art.

DESCRIPTION OF THE PREFERRED EMBODIMENT

Figure 2:
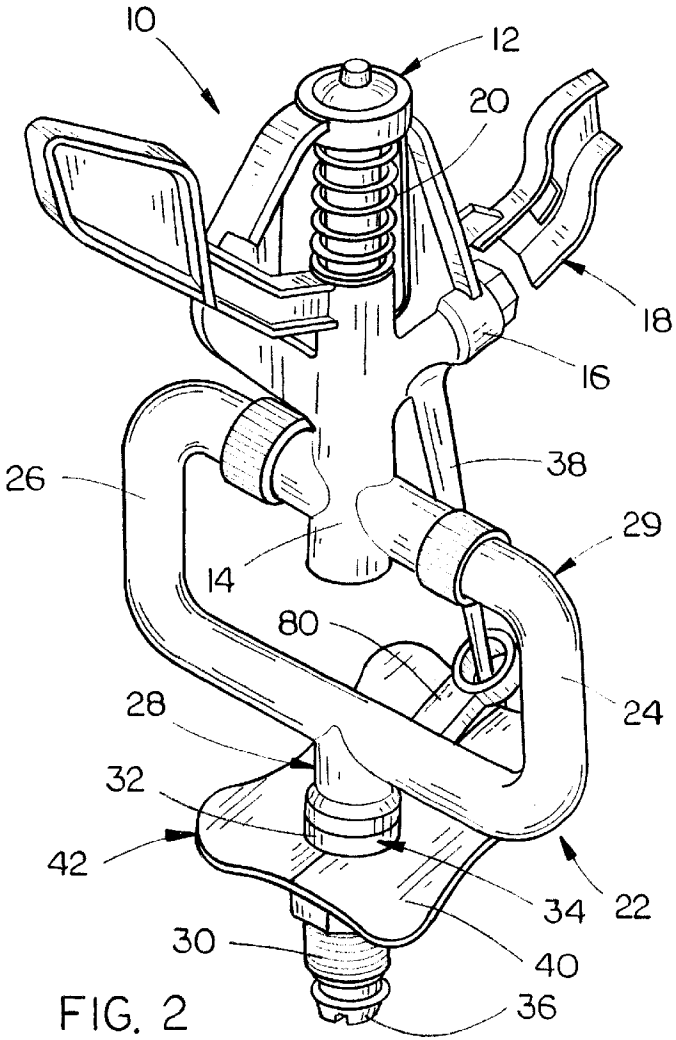
FIG. 2 is a perspective view of an embodiment of the variable pattern irrigation system of the present invention in a generally high trajectory position.

The irrigation device 10 of the present invention is generally depicted in FIGS. 2–6. The irrigation device 10 is provided with a head member 12 having a fluid inlet portion 14 and a fluid discharge portion 16. Generally, the discharge end portion 16 will be fitted with one of many known styles of spray nozzles. The sprinkler head 12 is depicted in the figures as being an impact sprinkler head having an impact arm 18 that is rotatably coupled with the head member 12 and is biased toward the path of the discharging fluid by a spring 20. However, it will be apparent to those of skill in the art that the improvements disclosed herein are equally applicable to rotary sprinkler systems and other sprinkler devices using various rotation systems.

The head member 12 of the irrigation device 10 is pivotably supported by a support member 22, having a fluid inlet portion 28 and an fluid outlet portion 29. In a preferred embodiment, the support member 22 is provided with at least two arm members 24 and 26, which pivotably engage the fluid inlet portion 14 of head member 12 to form a pivotable joint. The arm members 24 and 26 divide the water column that is received by the fluid inlet end portion 28. As the separate water columns exit the outlet end portion 30 of the support member 22, they are rejoined within the inlet portion 14 of the head member 12. Although the arm members 24 and 26 are generally depicted as being C-shaped, it is contemplated that the arm members 24 and 26 could be formed in a nearly limitless number of configurations. It is further contemplated that more than two arm members could be provided. However, it is important that the arm members provide at least one axis on which the head member 12 can pivot back and forth to vary the trajectory of the discharge end portion 16.

Figure 1:
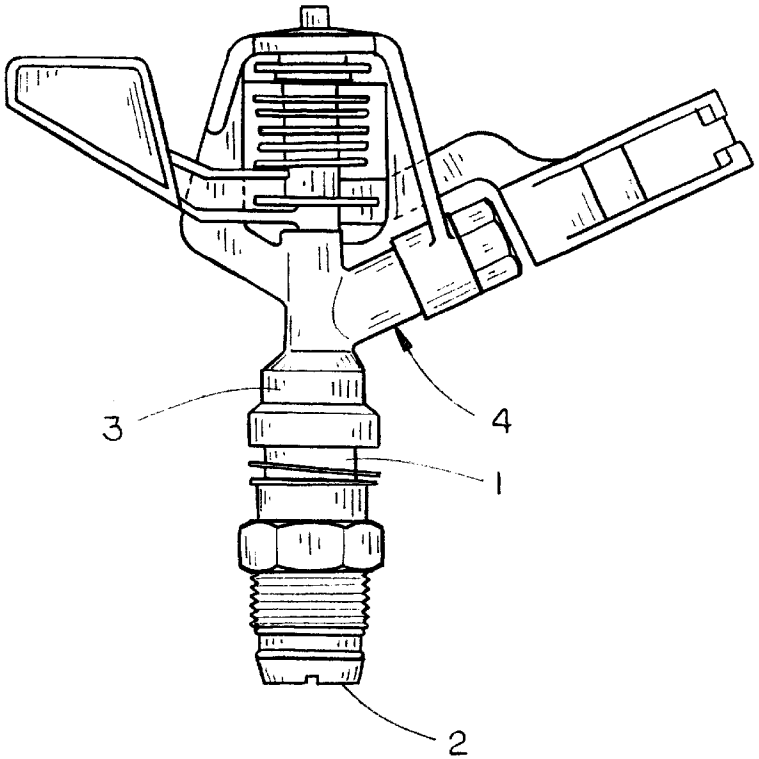
FIG. 1 (PRIOR ART)
FIG. 1 is a side elevation view of a prior art irrigation device.

It is preferred that the arm members 24 and 26 be configured so that a water brake is formed. The water brake checks the force of the water column before it reaches the head member 12. This prevents the formation of an "impact zone," which would potentially limit or alter the desired pivoting motion of the head member 12. Such impact effects readily occur within typical prior art assemblies. The prior art assembly shown within FIG. 1 includes a sprinkler body that rotates within a journal bearing 1, which secures the sprinkler to either an underground water supply or to a mobile base frame. The water supply enters the sprinkler at its inlet portion 2 and travels coaxially with the sprinkler body and typically impacts a joint member 3 that is provided for pivoting the sprinkler head in an upward and downward manner. This typically has the effect of either pinning the joint 3 in position or forcing the head 4 in the direction of the water column's path. Accordingly, it is desired to provide a water break, such as that provided by arm members 24 and 26, to prevent either of these phenomena from occurring and adversely affecting the operation of the head member.

The support member 22 is rotatably coupled to a journal member 32, which is located at the output end portion 34 of the stem 30. The journal member 32 permits the rotation of the head member 12 and support member 22 along its 360° path. The inlet end portion 36 of the stem 30 is engageable with nearly any contemplated fluid source, from an underground water line to a simple base frame that is selectively and movably positioned throughout the area to be watered.

The sprinkler 10 of the present invention creates a specific irrigation pattern by varying the trajectory on which the water is distributed from the head member 12 as it rotates about the stem 30. The trajectory is preferably dictated using a follower 38 and cam 40. The follower 38 is preferably an elongated member having one end coupled with either the head member 12 or the support member 22. The opposite end of the follower 38 slidably engages the peripheral edge portion 42 of the cam 40. The peripheral edge portion 42 is formed to provide the cam 40 with a particular shape. Examples of these particular shapes are depicted in FIGS. 4A–4D.

Figure 4A:
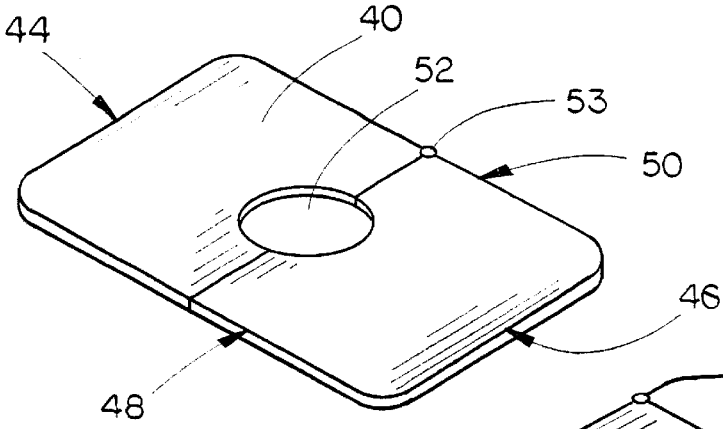
FIG. 4A is a top view of one embodiment of a cam which can be used as a part of the variable pattern irrigation system of the present invention.

The shape of the cam 40 dictates the shape of the resulting irrigation pattern. For example, the cam 40 depicted in FIG. 4A is generally rectangular in shape. It has opposite short side portions 44 and 46 and longer side portions 48 and 50. An opening 52 is formed in the center of the cam 40 and is preferably sized to receive the diameter of the stem 30. To facilitate the ease in mounting and removing the cam 40 to and from the stem 30, the cam may be split along one axis, such as between long side portions 48 and 50, and a pivot pin 53 or similar member may be coupled to the cam 40 closely adjacent the peripheral edge 42. This permits the opening of the cam 40 so that the stem 30 may be received within the opening 52. It is contemplated, however, that, where a flexible and resilient material is used to form the cam 40, a pivot pin may not be necessary.

Figure 3:
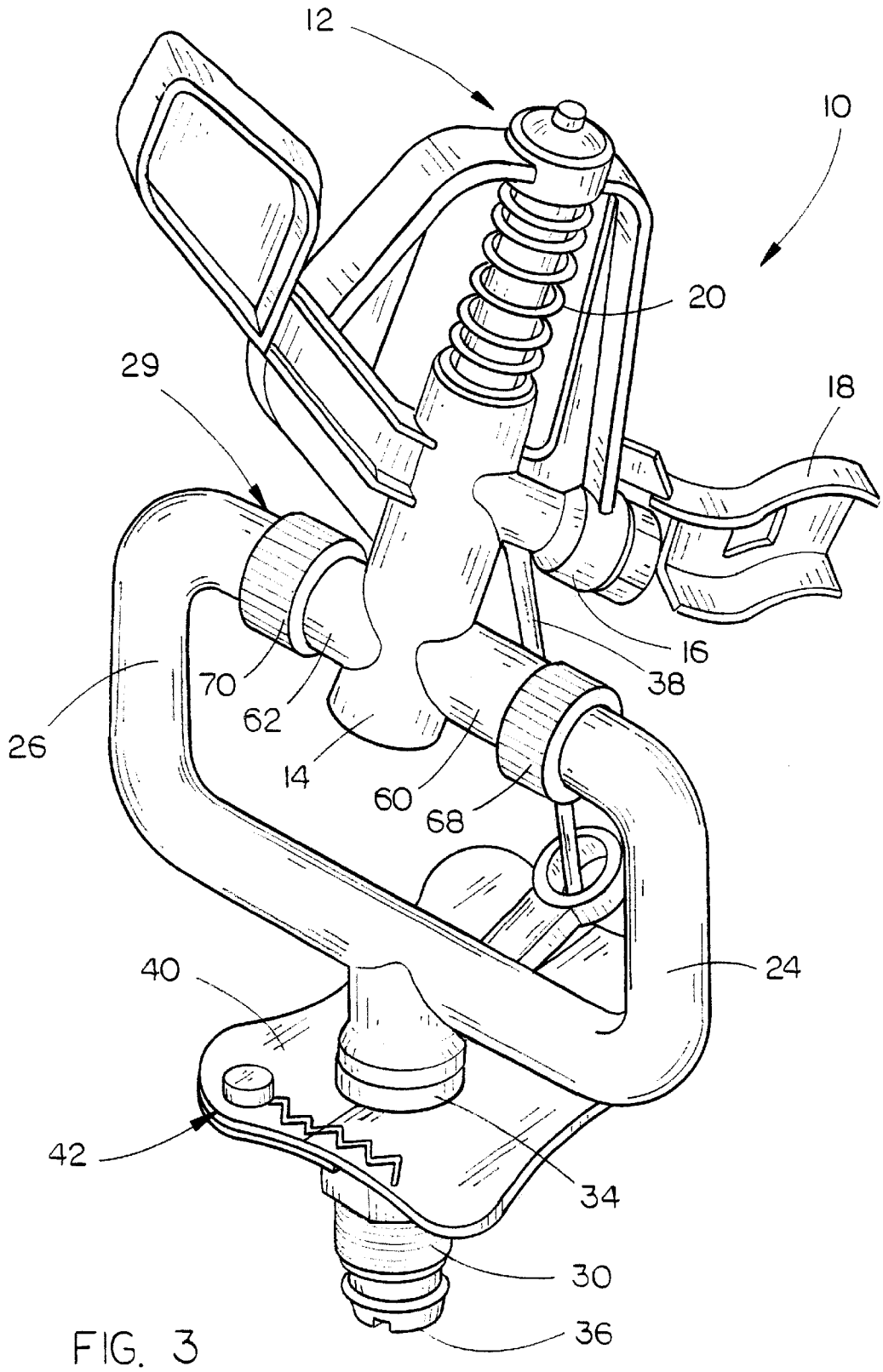
FIG. 3 is a perspective view of the variable pattern irrigation system of FIG. 2 in a generally low trajectory position.

In operation, as the follower 38 is slidably engaged with the short end portion 46, the head member 12 will be tilted rearwardly in a high trajectory position, as depicted in FIG. 2. As the sprinkler device 10 continues along its rotational path, the follower 38 slides along the peripheral edge portion 42 until it moves from the short side portion 46 to the long side portion 48. Due to the closer proximity of the longer side portion 48 to the opening 52, the follower 38 will move toward the stem 30, thus dropping the head member 12 forward into its low trajectory elevation, as depicted in FIG. 3. The low trajectory elevation directs the water more directly at the ground surface and thus travels a shorter distance than it did when the head portion 12 was in its high trajectory elevation. Accordingly, as the sprinkler device 10 completes a full 360° rotation, a rectangular irrigation pattern resembling the shape of the cam 40 will be produced.

Figure 4B:
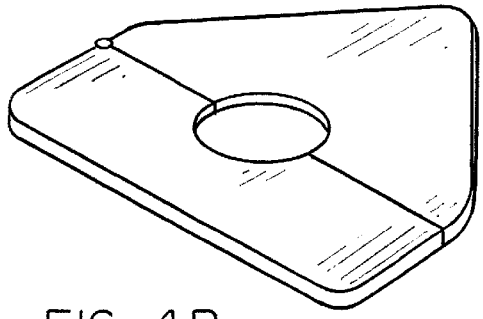
FIG. 4B is a top view of another embodiment of the cam of FIG. 4A.
Figure 4D:
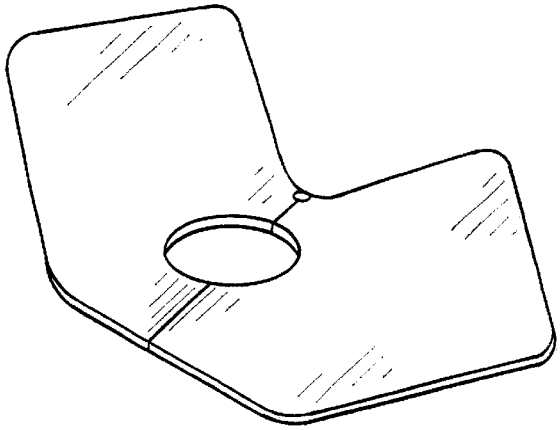
FIG. 4D is a top view of yet another embodiment of the cam of FIG. 4A.
Figure 4C:
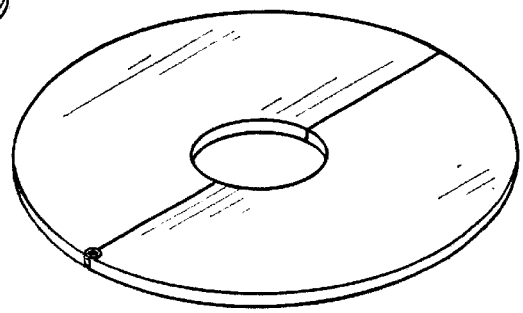
FIG. 4C is a top view of another embodiment of the cam of FIG. 4A.

For more irregular irrigation patterns, the cam 40 can be provided in nearly any required shape, as shown in FIGS. 4B and 4D. Again, the irrigation pattern created by the sprinkler device 10 will mimic the shape of the outer edge portion of the cam 40. Accordingly, where it is desired to have the typical round irrigation pattern, a round cam 40 could be provided, such as that depicted in FIG. 4C. It is contemplated that more than one cam 40 could be coupled with one another to provide an additional irrigation pattern variation without having to form a separate cam 40. For example, the round cam 40 of FIG. 4C could be positioned adjacent the upper or lower surface of the cam 40 depicted in FIG. 4A when they are positioned on the stem 30. In this configuration, the portion of the irrigation pattern mimicking the longer side portions 48 and 50 would become rounded and cover a larger area away from the sprinkler device 10 than if the cam 40 of FIG. 4A were used alone.

Figure 5:
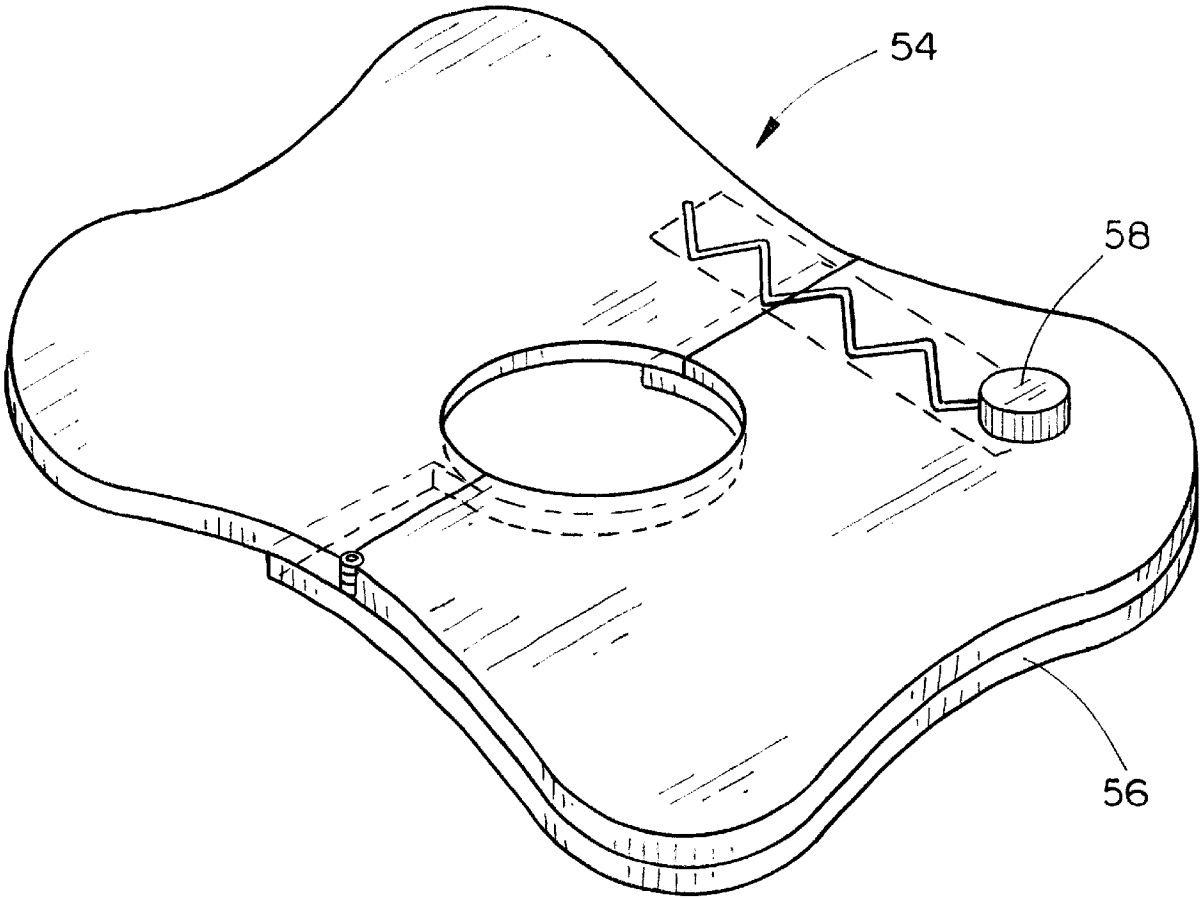
FIG. 5 is a perspective view of an embodiment of the adjustable cam of the present invention.

The irrigation pattern created by the sprinkler device 10 can be further altered where an adjustable cam 54 is provided, such as that depicted in FIG. 5. Cam 54 is similar to the cams 40, depicted in FIGS. 4A–4D. However, an extension plate 56 is slidably coupled with the upper or lower surface of the cam 54 and secured with a set screw 58 or similar structure. Accordingly, when it is desired to increase the size of the irrigation pattern created by the sprinkler device 10, the set screw 58 can be disengaged, and the adjustment plate 56 can be slid outwardly from the cam 54 by a desired distance. The set screw 58 would again be secured, and the system can be operated accordingly. It is contemplated that a plurality of adjustment plates 56 could be coupled to the cam 54 to provide for adjustments in more than one direction and in more than one axis.

Figure 6:
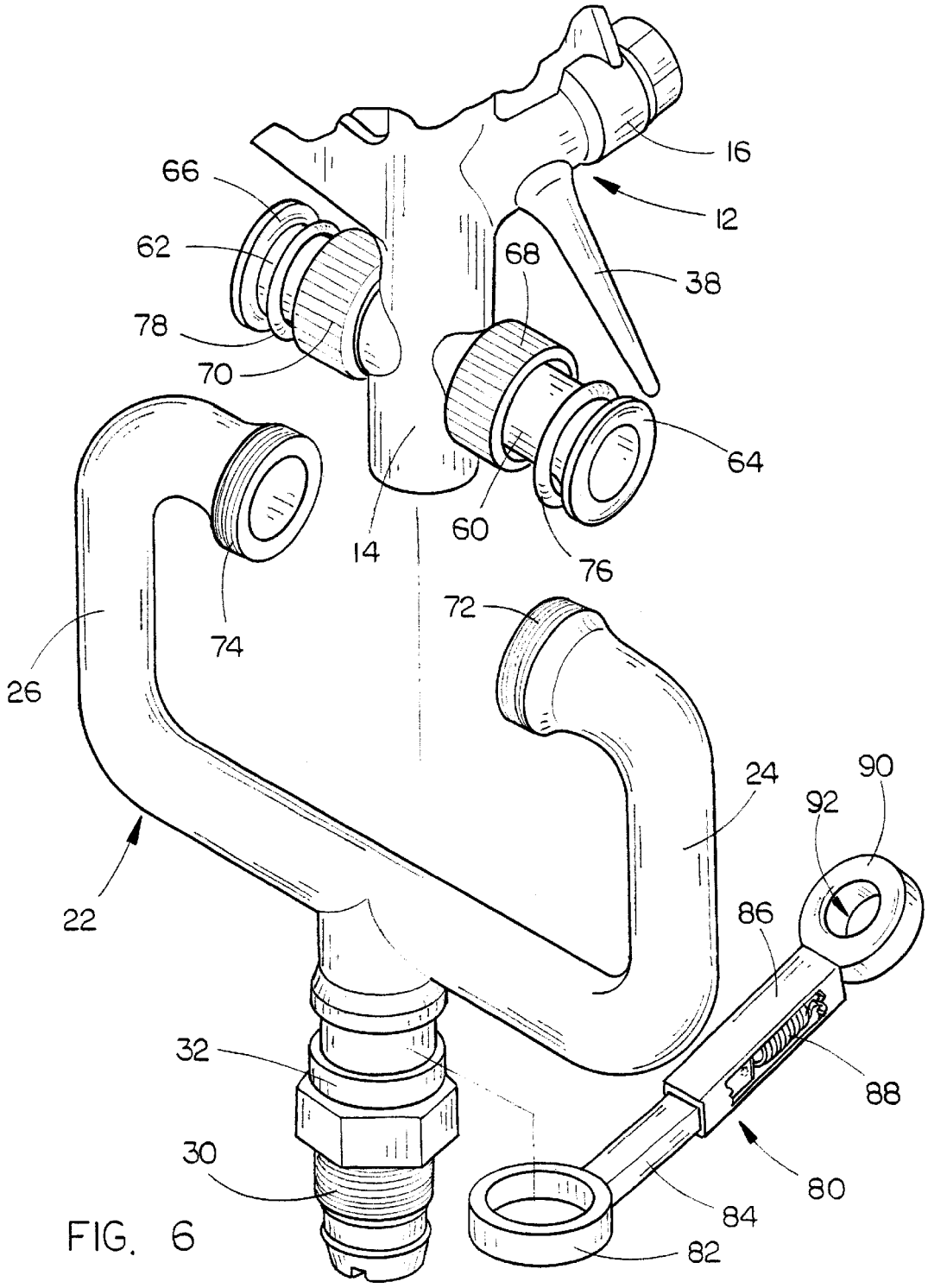
FIG. 6 is a partial exploded view of the support member of the variable pattern irrigation device of FIG. 2.

The trajectory joint of the present system, as mentioned previously, is provided by the coupling of the arm members 24 and 26 with the fluid inlet portion 14 of the head member 12. As depicted in FIG. 6, where the support member 22 is provided with two arm members, the fluid inlet portion 14 of the head member 12 will be provided with a pair of mating members 60 and 62 that are comprised at least of flanges 64 and 66 and a pair of collar members 68 and 70. It is preferred that the collar members 68 and 70 are provided with mating threads to receive the threaded ends 72 and 74 of the arm members 24 and 26. Accordingly, when the mating collars 68 and 70 are coupled to arm members 24 and 26, the flange members 64 and 66 engage the open end portions of the arm members 24 and 26 to permit the flow of the fluid into the fluid inlet portion of the head member 12. Seals 76 and 78, such as the resilient O-rings depicted in FIG. 6, can be provided for additional protection against the leaking of fluid from the pivoting joint. Similarly, additional seals of different materials and shapes can be provided where leaks are discovered between the flange members 64 and 66 and the open end portions of the arm members 24 and 26.

It is contemplated that, due to external forces and various operating conditions, that the force of the water being expelled from the outlet end portion 16 of the head member 12 could force the head member 12 to pivot rearwardly and disengage the follower 38 from the edge portion 42 of the cam 40. Accordingly, a retaining arm 80 can be provided to ensure continuous engagement between the follower 38 and the cam 40. The retaining arm 80, depicted in FIG. 6, is preferably provided with a pivot end portion 82 that is pivotably engaged with the support member 22 or the stem member 30. It is contemplated, however, that the pivot end portion 82 could be secured in a fixed position to the support member 22. An elongated arm 84 extends outwardly from the pivot end portion 82 and is slidably received within an arm housing 86. The arm 84 and arm housing 86 are preferably engaged to one another with a spring 88 within the arm housing 86. Accordingly, the length of the retaining arm 80 can fluctuate while remaining biased toward the pivot end 82. A collar portion 90 is preferably disposed on the free end of the arm housing 86 and slidably engages the length of the follower 38. It is preferred that the opening 92 within the collar portion 90 be sized to be only slightly larger than the diameter of the follower 38.

In use, the retaining arm 80 forces the follower 38 into engagement with the peripheral edge portion 42 of the cam 40 and resists the force of the water exiting the system from tipping the head member 12 rearwardly. As the shape of the cam 40 changes and the head member 12 pivots forwardly and rearwardly, the arm 84 and arm housing 86 move with respect to one another to accommodate the movement of the follower 38.

Figure 7:
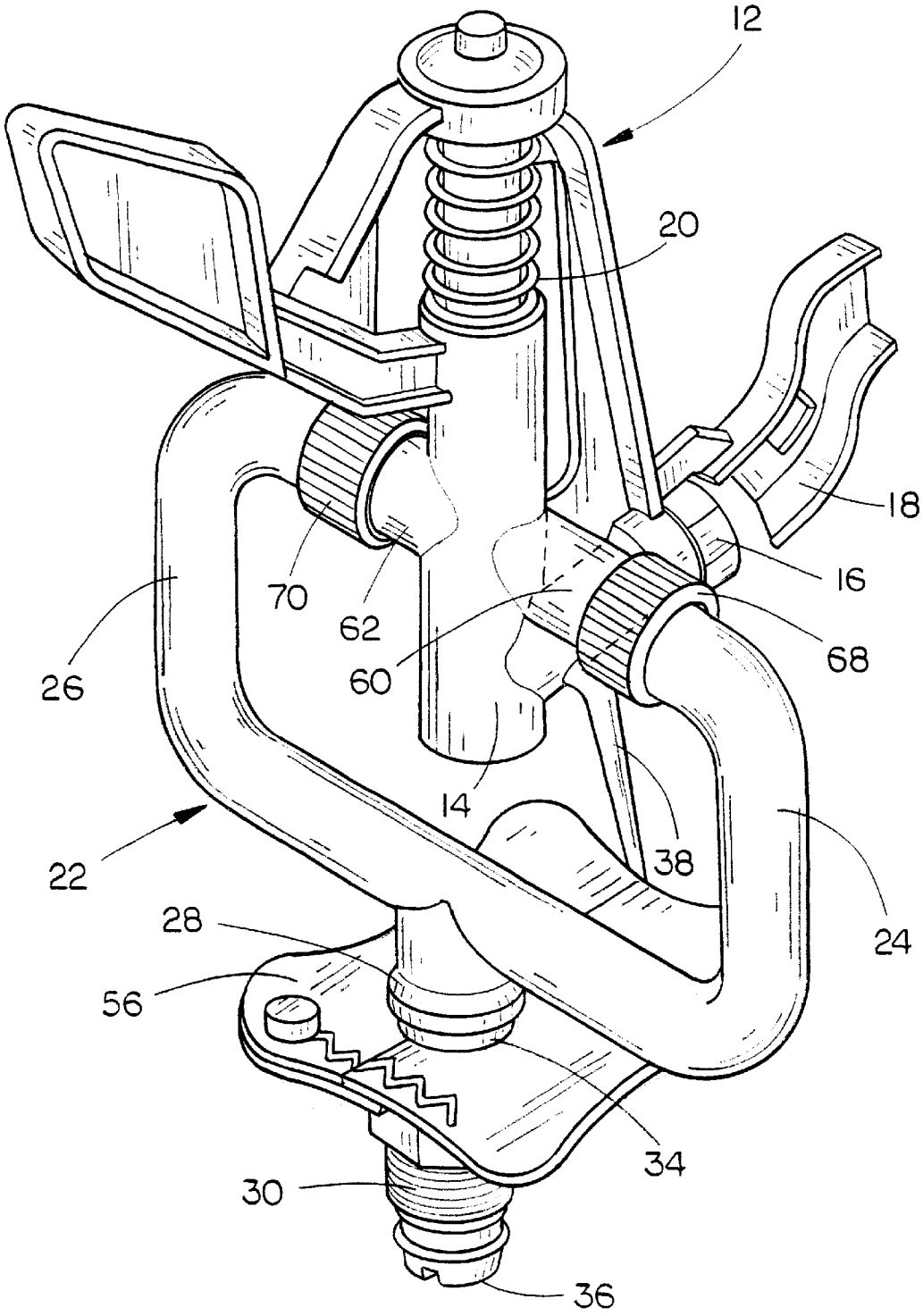
FIG. 7 is a perspective view of an alternate embodiment of the variable pattern irrigation system of FIG. 2.

In an alternate embodiment depicted in FIG. 7, the force of the exiting water is used to keep the follower 38 in constant contact with the peripheral edge portion 42 of the cam 40. This is accomplished by lengthening the arm members 24 and 26 and raising the location at which the mating members 60 and 62 engage the head member 12. It is preferred that the mating members 60 and 62 engage the head member 12 at a position slightly above the location at which the output end portion engages the head member 12. In this arrangement, the thrust provided by the exiting stream of water will tend to force the head to pivot in a generally downward direction and maintain the engagement between the follower 38 and the peripheral edge portion 42 of the cam 40.

In the drawings and in the specification, there have been set forth preferred embodiments of the invention; and although specific items are employed, these are used in a generic and descriptive sense only and not for purposes of limitation. Changes in the form and proportion of parts, as well as substitution of equivalents, are contemplated as circumstances may suggest or render expedient without departing from the spirit or scope of the invention as further defined in the following claims.

Thus it can be seen that the invention accomplishes at least all of its stated objectives.

I claim:

1. A sprinkler device for distributing fluid, comprising:

a head member having a fluid inlet portion and a fluid outlet portion;

a support member having a fluid inlet portion, a fluid outlet portion and a plurality of arm members adjacent said fluid outlet portion; said support member having a fluid passageway formed from said fluid inlet through said arm members to said fluid outlet; said fluid inlet portion of said head member being operatively pivotably coupled to the fluid outlet portion of said support member;

a stem member having a fluid inlet portion and a fluid outlet portion; said fluid inlet portion of said support member being operatively pivotably coupled to the fluid outlet portion of said stem member; and means for rotating said head member and said support member with respect to said stem member.

2. The sprinkler device of claim 1 wherein said means for rotating said head member and said support member is comprised of an impact arm operatively coupled with said head member.

3. The sprinkler device of claim 1 wherein said head member and said support member are pivotable about separate axes; said axes being generally perpendicular with one another.

4. The sprinkler device of claim 1 further comprising means for determining a selectively variable trajectory along which the fluid is distributed.

5. The sprinkler device of claim 1 further comprising a follower operatively coupled to said head member and a cam operatively coupled to said stem member; said follower and cam being engageable with one another to define a trajectory along which the fluid is distributed.

6. The sprinkler device of claim 5 wherein said follower is generally elongated with first and second end portions; said first end portion being operatively coupled to said head member and said second end portion being operatively engaged with said cam.

7. The sprinkler device of claim 6 wherein said cam is generally plate-shaped, having a peripheral edge portion; said second end portion of said follower being selectively movably engaged with the peripheral edge portion of said cam.

8. The sprinkler device of claim 5 wherein said cam has a peripheral edge portion that defines a shape closely resembling a shaped area in which the fluid is distributed.

9. The sprinkler device of claim 8 wherein said cam is provided with an extension plate that is selectively positionable with respect to the peripheral edge portion of said cam to alter the shape defined by said peripheral edge portion.

10. The sprinkler device of claim 8 wherein said cam is selectively removable from the sprinkler device.

11. The sprinkler device of claim 10 further comprising at least one alternate cam having a peripheral edge portion, that is removably and operatively engageable with said stem member.

12. The sprinkler device of claim 11 wherein the peripheral edge portion of said at least one alternate cam defines a shape different from the shape defined by the peripheral edge portion of said cam.

13. The sprinkler device of claim 12 wherein said cam and said at least one alternate cam are operatively engageable with said stem member alone or in combination with one another.

14. The sprinkler device of claim 6 further comprising means for urging said follower into engagement with said cam.

15. The sprinkler device of claim 6 further comprising an elongated retaining arm operatively coupled to said follower so that said follower is urged into engagement with said cam.

16. The sprinkler device of claim 15 wherein said retaining arm is resiliently length-expandable.

17. The sprinkler device of claim 6 wherein the fluid outlet portion of said head member is positioned with respect to said arm members so that said follower is urged into engagement with said cam when the sprinkler device is distributing the fluid.

18. A sprinkler for distributing a fluid with an area having a defined shape, comprising:

a head member having a fluid inlet and a fluid outlet;

a support member operatively pivotably coupled to said head member;

a stem member operatively pivotably coupled to said support member;

means for automatically rotating said head member and said support member with respect to said stem member;

a follower, having first and second end portions, operatively coupled to said head member;

a cam, having a peripheral edge portion defining a shape, operatively coupled to said stem member; said second end portion of said follower being selectively movably engageable with the peripheral edge portion of said cam; and means for selectively changing the shape defined by the peripheral edge of said cam.

19. The sprinkler of claim 18 wherein said support member has fluid inlet and fluid outlet end portions and a plurality of separate arm members generally intermediate said fluid input and fluid output portions; said arm members being in open fluid communication with said fluid inlet and outlet portions.

20. The sprinkler of claim 19 wherein said arm members are operatively pivotably coupled with the fluid inlet of said head member so that said head member can be selectively tilted between a plurality of fluid distributing trajectories.

21. The sprinkler of claim 18 wherein said cam is selectively removable from the sprinkler.

22. The sprinkler of claim 21 further comprising a plurality of alternate cam members, wherein each of said plurality of alternate cam members is selectively removably engageable with said stem member.

23. The sprinkler of claim 22 wherein each of said plurality of alternate cam members has a peripheral edge portion that defines a shape that is unique among said plurality of alternate cam members.

24. The sprinkler of claim 21 further comprising a cam blank that can be selectively shaped and operatively engaged with said stem member.

25. The sprinkler of claim 18 further comprising means for urging said follower into engagement with said cam.

26. The sprinkler of claim 18 further comprising an elongated retaining arm operatively coupled to said follower so that said follower is urged into engagement with said cam.

27. The sprinkler of claim 26 wherein said retaining arm is resiliently length-expandable.

28. The sprinkler of claim 19 wherein the fluid outlet portion of said head member is positioned with respect to said arm members so that said follower is urged into engagement with said cam when the sprinkler device is distributing the fluid.

* * * * *